United States Patent [19]

Caldwell

[11] 4,436,307

[45] Mar. 13, 1984

[54] DEVICE FOR FACILITATING ASSEMBLY, STORAGE AND TRANSPORTATION OF A JIGSAW PUZZLE

[75] Inventor: T. Francis Caldwell, Rockford, Ill.

[73] Assignee: Puzzle Specialties, St. Charles, Ill.

[21] Appl. No.: 386,926

[22] Filed: Jun. 10, 1982

[51] Int. Cl.[3] ..... A63F 9/10

[52] U.S. Cl. ..... 273/157 R; 206/315.1 206/454; 229/31 FS

[58] Field of Search ..... 273/157 R, 285; 206/454, 594, 315 R; 229/31 FS, 40

[56] References Cited

U.S. PATENT DOCUMENTS

| | | | |
|---|---|---|---|
| 1,530,637 | 3/1925 | Anderson | 273/285 |
| 1,707,680 | 4/1929 | Norwood | 229/40 X |
| 3,162,350 | 12/1964 | Miller | 229/31 FS |
| 3,504,915 | 4/1970 | Walker | 273/157 R |
| 3,792,668 | 2/1974 | Ward | 273/157 R |
| 3,974,576 | 8/1976 | Quinn | 434/155 |
| 4,302,013 | 11/1981 | Kavis | 273/157 R |

*Primary Examiner*—Anton O. Oechsle

*Attorney, Agent, or Firm*—Leydig, Voit, Osann, Mayer & Holt, Ltd.

[57] ABSTRACT

The device includes an assembly tray for holding assembled pieces of a jigsaw puzzle and includes two storage trays for holding unassembled puzzle pieces. The storage trays are adapted to be placed in side-by-side relation in the assembly tray and hold the assembled puzzle pieces in assembled relation when the device is picked up and carried. Filler blocks are adapted to be placed in the storage trays to hold the unassembled pieces therein in position when the device is picked up and carried. A releasable cover holds the filler blocks, the storage trays and the assembly tray together as a compact unit.

11 Claims, 9 Drawing Figures

DEVICE FOR FACILITATING ASSEMBLY, STORAGE AND TRANSPORTATION OF A JIGSAW PUZZLE

BACKGROUND OF THE INVENTION

This invention relates to a device for facilitating assembly of the pieces of a jigsaw puzzle and for enabling the assembled or partially assembled puzzle to be stored and/or transported from place-to-place. Devices for facilitating the assembly of a jigsaw puzzle are disclosed in Lathrop U.S. Pat. No. 4,111,425 and Kavis U.S. Pat. No. 4,302,013.

SUMMARY OF THE INVENTION

The general aim of the present invention is to provide a new and improved jigsaw puzzle assembling and carrying device which is of relatively inexpensive construction, which enables organized assembly of the puzzle pieces and which enables both assembled and unassembled pieces to be stored or transported from place-to-place without disturbing the position of the pieces.

In brief, the device comprises a main assembly tray having a bottom surface upon which the puzzle pieces may be assembled. The device also comprises a plurality of storage trays, there preferably being two storage trays, which are adapted to fit within and substantially fill the assembly tray when the device is not in use. To use the device, the storage trays are removed from the assembly tray and are placed at opposite ends of the assembly tray. Unassembled puzzle pieces may be grouped in an organized fashion in the two storage trays according to general color, shape or the like and may be selected from the storage trays and fitted together on the assembly tray.

When the puzzle is finished or partially finished and is to be stored or toted, the storage trays are replaced in side-by-side relation in the assembly tray and uniquely serve to hold the assembled pieces in assembled relationship. In addition, filler blocks are placed in the storage trays and keep any unassembled pieces from turning over or from substantially shifting position in those trays. A cover then is wrapped around the assembly tray and the outer sides of the blocks. The cover holds all of the components tightly together as a unit and preferably includes a handle to enable the device to be picked up and easily carried.

The invention also resides in the unique provision of compressible anti-skid surfaces on the bottoms of the storage trays to prevent slippage of the assembled puzzle pieces in the assembly tray when the device is transported; in the novel construction of the cover to hold the assembly tray, the storage trays and the filler blocks tightly together as a compact unit; and in the manner in which the cover may be easily opened and closed.

These and other objects and advantages of the invention will become more apparent from the following detailed description when taken in conjunction with the accompanying drawings.

DETAILED DESCRIPTION OF THE PREFERRED EMBODIMENT

Figure 9:
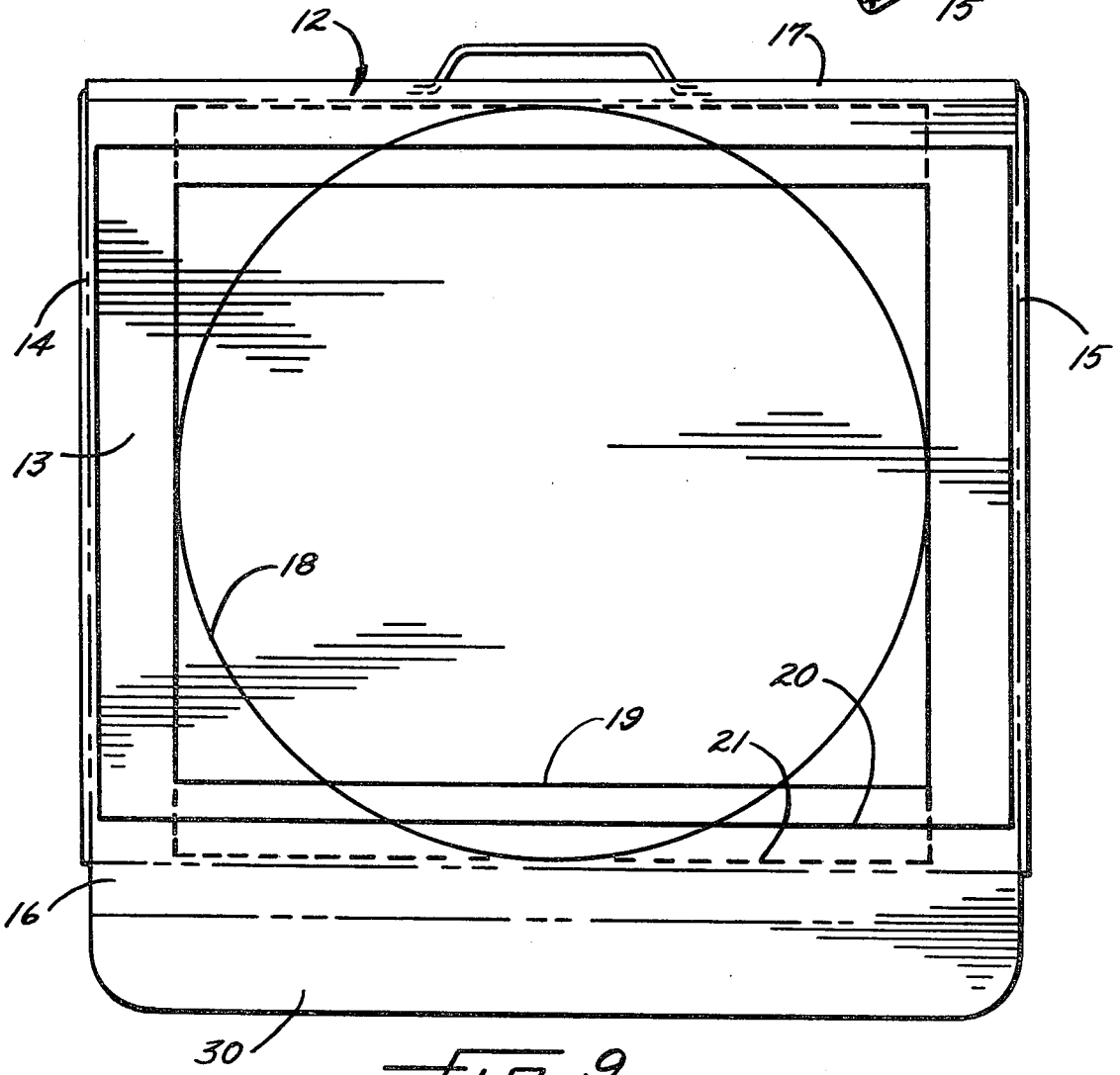
FIG. 9 is an enlarged top plan view of the assembly tray.

As shown in the drawings for purposes of illustration, the invention is embodied in a new and improved device 10 for enabling organized assembly of the pieces of a jigsaw puzzle 11 and for enabling either a partially or fully assembled puzzle to be stored or to be carried to different places. The device includes a main assembly tray 12 within which the puzzle is adapted to be assembled. The assembly tray preferably is made of corrugated paperboard and includes a bottom wall 13 (FIGS. 5 and 9) and four upstanding side walls 14, 15, 16 and 17, the tray being rectangular in shape. Different markings 18, 19, 20 and 21 (FIG. 9) are formed on the upper surface of the bottom wall 13 and defining the outlines for a circular puzzle and for rectangular puzzles of various dimensions. The upper surface of the bottom wall 13 preferably is white in color in order to provide a contrasting background for most puzzle pieces.

Figure 7:
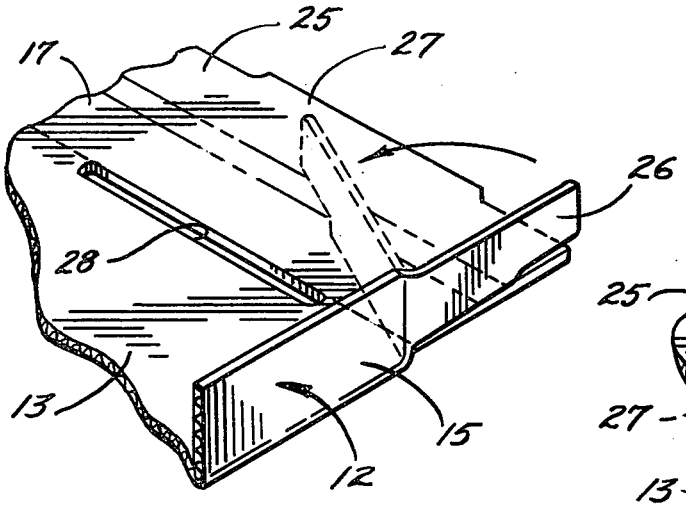
FIG. 7 is a perspective view of a portion of the assembly tray before that tray has been assembled.
Figure 8:
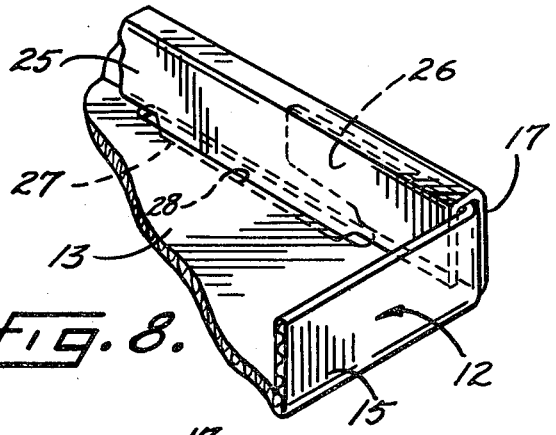
FIG. 8 is a view similar to FIG. 7 but shows the assembly tray after the latter has been assembled.

Each of the side walls 14, 15 and 16 of the assembly tray 12 is folded upwardly from the bottom wall 13 and extends perpendicular thereto. The upper side wall 17 also is folded upwardly from the bottom wall 13 and includes a reversely or downwardly folded strip 25 (FIGS. 7 and 8) whose ends overlap short tabs 26 projecting inwardly at right angles from the adjacent ends of the side walls 14 and 15. The tabs 26 are sandwiched between the side wall 17 and the strip 25 and prevent the side walls 14 and 15 from folding downwardly. Additional tabs 27 (FIGS. 7 and 8) are formed on the lower edge of the strip 25 and project through slots 28 in the adjacent margin of the bottom wall 13 to hold the side wall 17 and the strip 25 in an upright position. One or more staples (not shown) may be driven through the side wall 17 and the strip 25 to hold the two together.

Figure 1:
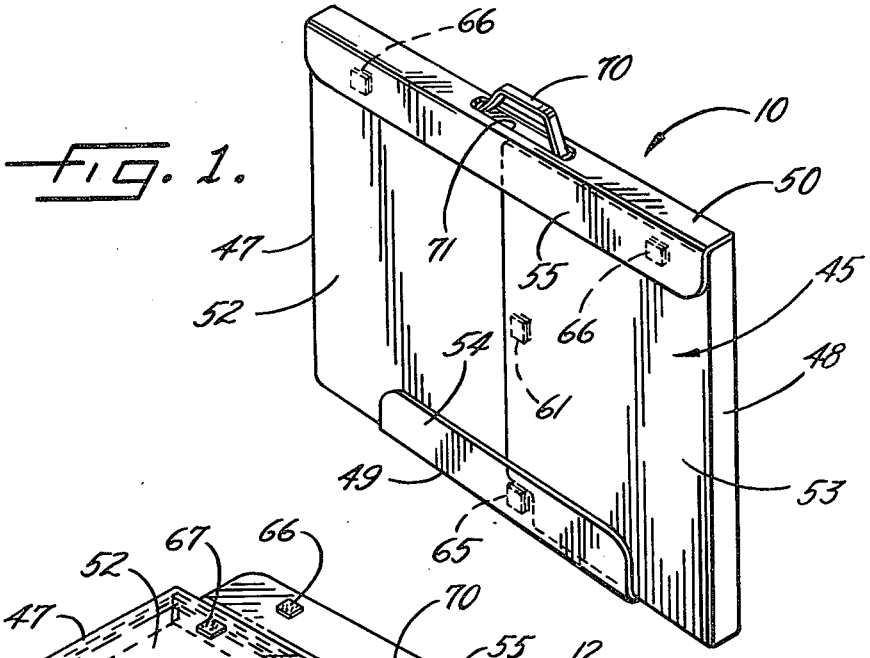
FIG. 1 is a perspective view of a new and improved jigsaw puzzle assembling and carrying device incorporating the unique features of the present invention.
Figure 5:
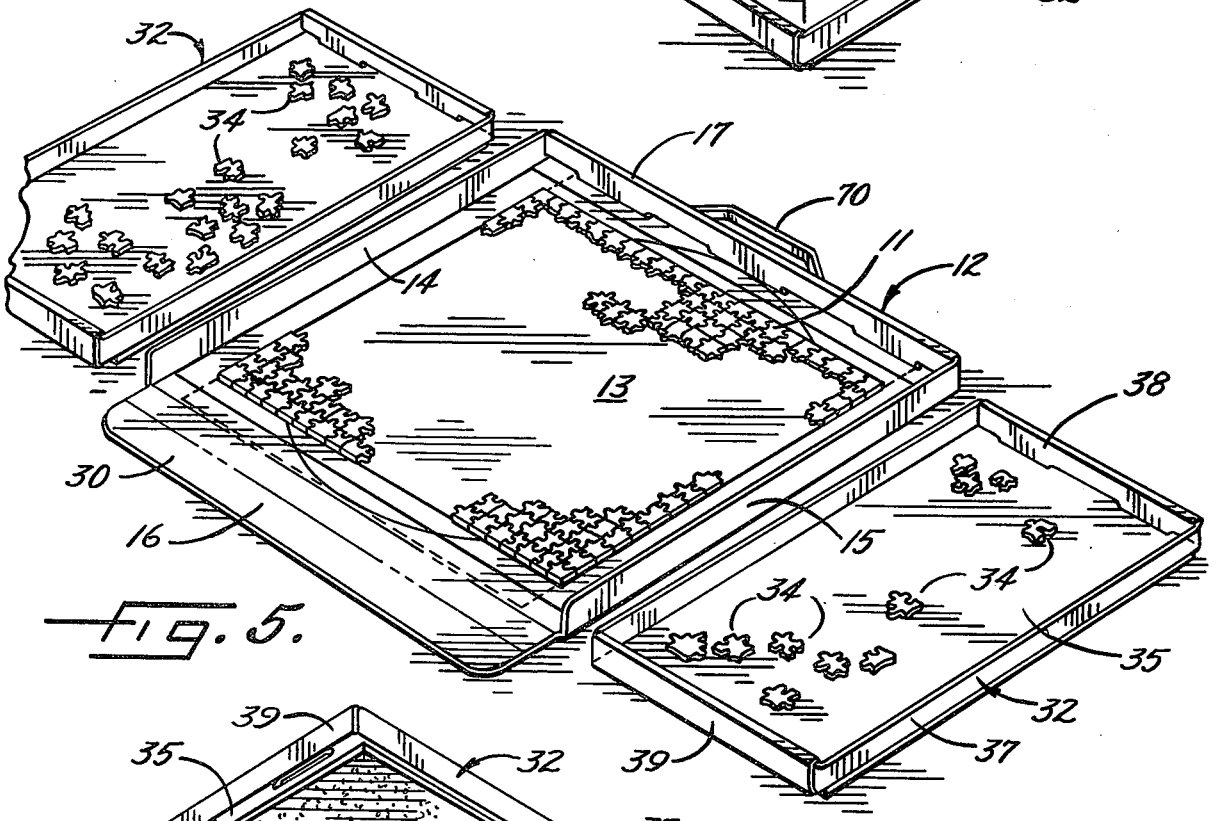
FIG. 5 is a perspective view showing both storage trays removed from the assembly tray.

The lower side wall 16 of the assembly tray 12 also is hinged to the bottom wall 13 and is advantageously adapted to be folded from an upright position (FIG. 2) to an outwardly extending horizontal position (FIG. 5). In the latter position, the side wall 16 lies flat in order to enable easier access to the assembly tray 12. For a purpose to be explained later, a flap 30 is hinged to the upper margin of the side wall 16 and extends inwardly when the side wall 16 is in its upright position (FIG. 1). When the side wall 16 is folded downwardly, the flap 30 also moves to a substantially flat horizontal position (FIG. 5).

Figure 4:
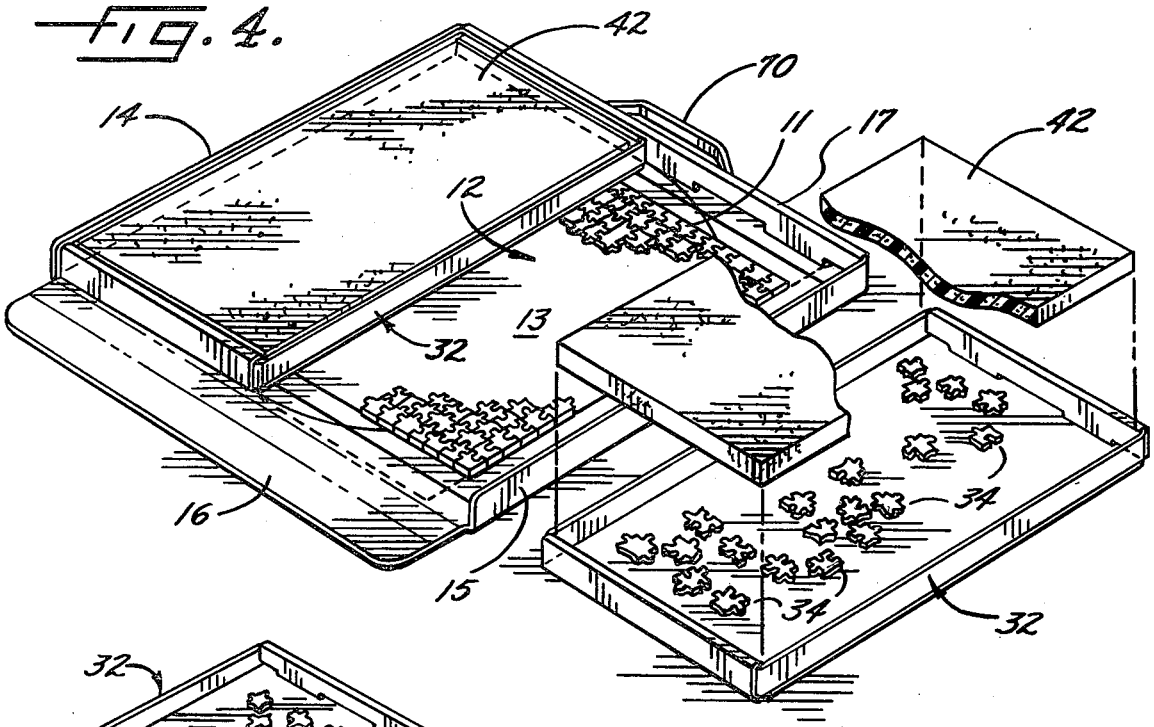
FIG. 4 is a partially exploded perspective view of the device with the cover removed and with one storage tray removed from the assembly tray.
Figure 6:
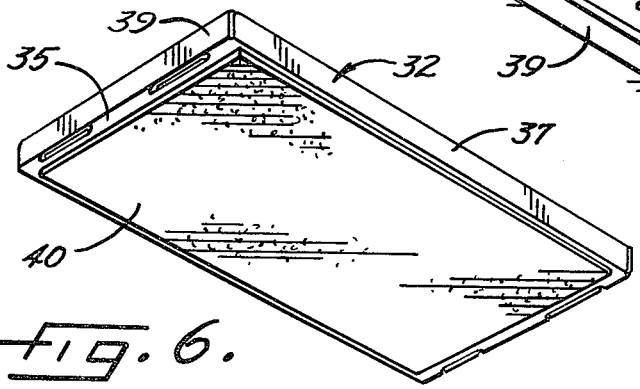
FIG. 6 is a perspective view of one of the storage trays.

In carrying out the invention, the device 10 also includes a plurality of storage trays 32 (FIGS. 4 to 6) adapted to fit removably in the assembly tray 12 and adapted to substantially fill the assembly tray. The storage trays 32 serve two functions, namely, to hold unassembled puzzle pieces 34 in an organized grouping and to captivate the assembled puzzle pieces 11 in assembled relation on the assembly tray 12 when the device 10 is stored or transported.

Herein, two storage identical trays 32 are provided. Each storage tray is generally rectangular and includes a bottom wall 35 (FIGS. 5 and 6) and four upstanding side walls 36, 37, 38 and 39. The overall height each storage tray 32 is approximately equal to the overall height of the assembly tray 12, the overall length of each storage tray is just slightly less than the overall length of the assembly tray, and the overall width of each storage tray is first slightly less than one-half the width of the assembly tray. The storage trays are adapted to be placed in side-by-side relation in the assembly tray (see FIG. 29 with the lower sides of the bottom walls 35 of the storage trays disposed face-to-face with the upper side of the bottom wall 13 of the assembly tray. When so placed, the storage trays nest within and substantially fill the assembly tray, the side walls of the storage trays being disposed closely adjacent the side walls of the assembly tray so as to prevent any substantial lateral shifting of the storage trays within the assembly tray.

Each storage tray 32 preferably is made of corrugated paperboard and its side walls 36, 37 and 38 are formed in a manner virtually identical to the side walls 14, 15 and 17, respectively, of the assembly tray 12. The side wall 39 of each storage tray is formed in the same manner as the side wall 38 of that tray. Preferably, the bottom wall 35 of each storage tray is white in color.

To use the device 10, the storage trays 32 are removed from the assembly tray 12 and are placed adjacent the end walls 14 and 15 of the assembly tray. The puzzle pieces 34 of a puzzle to be worked then may be placed picture-side-up in the storage trays. To facilitate organization of the pieces, certain pieces such as edge pieces may be grouped in one storage tray while center pieces may be grouped in the other storage tray. Alternatively, the pieces 34 may be separated in the two trays 32 in accordance with the general colors of the pieces. Once the pieces have been organized in the storage trays in a desired manner, the pieces may be fitted together on the bottom wall 13 of the assembly tray 12.

Frequently, a puzzle 11 is not fully assembled during a single session. The present device 10 is particularly adapted to enable both the assembled and unassembled pieces 11 and 34 to be conveniently stored and transported between sessions without danger of the position of any of the pieces being disturbed.

Figure 2:
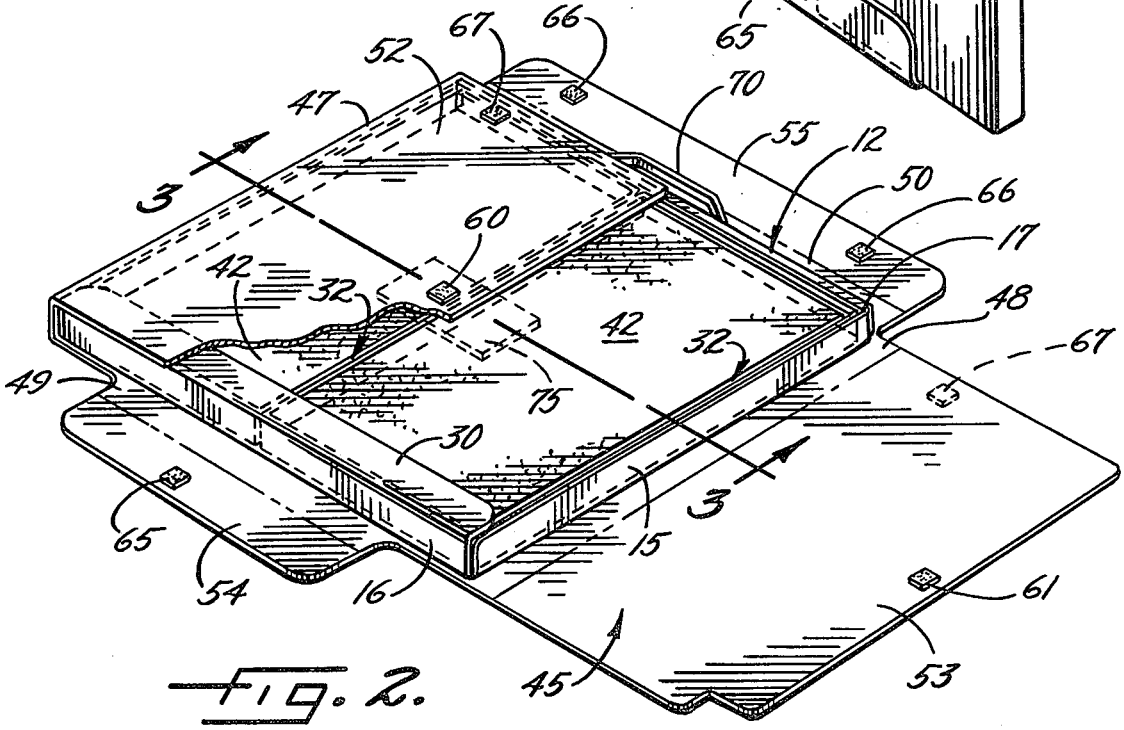
FIG. 2 is another perspective view of the device and shows the cover partially opened.

In order to maintain the assembled pieces 11 in the assembly tray 12 in assembled relationship during transport, the storage trays 32 are placed in side-by-side relation and bottom-side-down in the assembly tray (see FIG. 2). Advantageously, sheets 40 of compressible anti-skid material such as polyurethane foam rubber are cemented to and substantially cover the lower sides of the bottom walls 35 of the storage trays 32. The anti-skid sheets 40 frictionally engage the assembled puzzle pieces 11 in the assembly tray 12 to hold such pieces in assembled relationship and to prevent the assembled puzzle from slipping edgewise in the assembly tray.

Figure 3:
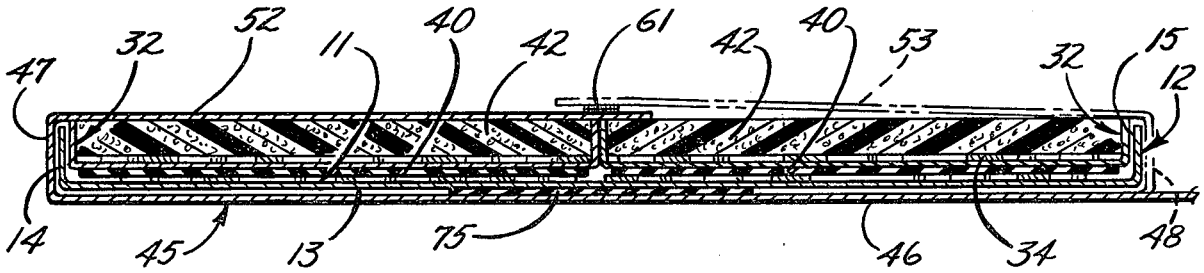
FIG. 3 is an enlarged fragmentary cross-section taken substantially along the line 3—3 of FIG. 2.

To maintain the unassembled pieces 34 in a picture-side-up position in the storage trays 32 during storage and transport, filler blocks 42 (FIGS. 2 to 4) are placed in the storage trays. Each filler block has approximately the same overall height, as the respective storage tray and has an overall length and width just slightly less than the overall length and width of the respective storage tray so that each block may nest within and substantially fill the tray. The filler blocks preferably are made of light weight material such as styrofoam.

In keeping with the invention, a cover 45 (FIGS. 1 to 3) is adapted to be connected to the assembly tray 12 and to be placed over the filler blocks 42 in order to hold the filler blocks securely in the storage trays 32 and to hold the storage trays securely in the assembly tray. In the present instance, the cover also is made of corrugated paperboard and includes a bottom wall 46 (FIG. 3) which is approximately the same size as and which is adapted to underlie the bottom wall 13 of the assembly tray 12. Four side walls 47, 48, 49 and 50 (FIGS. 1 to 3) which are approximately the same height as the side walls 14 to 17 of the assembly tray are hinged to the bottom wall 46 of the cover and are adapted to be folded upwardly therefrom so as to lie alongside the side walls of the assembly tray. Flaps 52, 53, 54 and 55 are hinged to the upper margins of the side walls 47, 48, 49 and 50, respectively, and are adapted to fold upwardly from generally horizontal open positions to closed positions overlying the outer sides of the filler blocks 42. The flaps 52 and 53 have approximately the same rectangular dimensions as the storage trays 32 and may serve as a convenient supporting surface for those trays when the flaps are open and the bottom wall 46 of the cover 45 is left beneath the bottom wall 13 of the assembly tray 12 during assembly of the puzzle 11. Alternatively, the cover 45 may be completely removed from the assembly tray and set aside with the filler blocks 42 during assembly of the puzzle.

The cover 45 is closed after the storage trays 32 have been placed in the assembly tray 12 and after the filler blocks 42 have been placed in the storage trays. To close the cover, the flap 52 is folded into overlying relation with one of the filler blocks 42 and with a side marginal portion of the other filler block. Prior to such folding, the side wall 16 of the assembly 12 is swung to its upright position and the flap 30 thereof is folded over the end portions of the filler blocks 42 so that the flap 30 underlies the flap 52 when the latter is closed. The flap 53 then is folded into overlying relation with the flap 52 and is secured releasably thereto by coacting pieces 60 and 61 of Velcro-type material (see FIG. 2). The Velcro piece 60 is cemented to the upper side of the flap 52 while the Velcro piece 61 is cemented to the underside of the flap 53.

The flap 54 then is folded over the flaps 52 and 53 and is secured releasably thereto by a piece 65 of Velcro-type material cemented to the underside of the flap 54 and adapted to coact with another piece (not shown) of Velcro-type material on the upper side of the flap 52. Additional pieces 66 of Velcro-type material are cemented to the underside of the flap 55 and are adapted to coact with pieces 67 of Velcro-type material on the upper sides of the flaps 52 and 53. When the flap 55 is folded to a closed position, the Velcro pieces 66 interlock with the Velcro pieces 67 to hold the flap 55 tightly closed.

Advantageously, a U-shaped handle 70 (FIGS. 1 and 2) made of plastic is secured to the side wall 17 of the assembly tray 12. When the flap 55 of the cover 45 is folded closed, the handle projects through a slot 71 in the side wall 50 of the cover, the handle thereby providing a convenient means by which the device 10 may be carried.

When all of the flaps 52 to 55 are closed and are secured by the Velcro-type pieces, the filler blocks 42 are pressed tightly against the unassembled puzzle pieces 34 in the storage trays 32 and prevent such pieces from shifting when the device 10 is turned to an edgewise position and is picked up and carried by the handle 70. In addition, the anti-skid sheets 40 on the undersides of the bottoms of the storage trays 32 engage the assembled puzzle pieces 11 and prevent any slippage of those pieces. Being compressible, the sheets 40 act somewhat like springs to force the puzzle pieces 11 against the bottom 13 of the assembly tray 12 and hold the puzzle pieces tightly in place even though the bottom 13 of the assembly tray may tend to warp somewhat due to the fact that it is made of paperboard. To further help hold the puzzle pieces 11 in place, a sheet 75 (FIGS. 2 and 3) of polyurethane foam rubber is cemented to the upper side of the bottom wall 46 of the cover 45. The sheet 75 also acts in the manner of a spring and pushes the assembly tray 12 toward the flaps 52 and 53 to help keep the various components packed tightly together even though the paperboard may be slightly warped.

When the device 10 is picked up by the handle 70, the flap 30 on the assembly tray 12 engages the filler blocks 42 and helps to prevent the weight of the components from opening the flap 54. Thus, the cover 45 remains tightly around the trays 12 and 32 and the filler blocks 42 when the device 10 is picked up and carried.

From the foregoing, it will be apparent that the present invention brings to the art a new and improved device 10 for facilitating the assembly, storage and transportation of a jigsaw puzzle 11. The device is comparatively compact and lightweight and is relatively simple in construction.

I claim:

1. A device for facilitating assembly of a jigsaw puzzle and for enabling the puzzle to be transported, said device comprising a generally rectangular assembly tray for holding assembled puzzle pieces, a plurality of generally rectangular storage trays for holding unassembled puzzle pieces, each of said trays having a bottom wall and four upstanding side walls, the overall height of each storage tray being approximately equal to the overall height of the assembly tray, the overall length of each storage tray being slightly less than the overall length of the assembly tray, and the combined overall widths of the plurality of storage trays being slightly less than the overall width of the assembly tray whereby said storage trays may nest removably within and substantially fill said assembly tray, the bottoms of said storage trays being located adjacent the bottom of said assembly tray and engaging any assembled puzzle pieces therein to hold such pieces in assembled relationship when said assembly tray is turned on edge and transported, generally rectangular filler blocks for each of said storage trays, each of said filler blocks having an overall height approximately equal to the overall height of the respective filler tray and having an overall length and width somewhat less than the overall length and width of the respective filler tray whereby said filler blocks may nest removably within and substantially fill the respective storage tray, the bottoms of said blocks engaging any unassembled puzzle pieces in said storage trays and preventing such pieces from becoming inverted within said storage trays, and a removable cover disposed in covering relation with the outer sides of said blocks and connected to said assembly tray, said cover holding said blocks in said storage trays and holding said storage trays in said assembly tray.

2. A device for facilitating assembly of a jigsaw puzzle and for enabling the puzzle to be transported, said device comprising a generally rectangular assembly tray for holding assembled puzzle pieces, a plurality of generally rectangular storage trays for holding unassembled puzzle pieces, each of said trays having a bottom wall and four upstanding side walls, said storage trays being sized and shaped so as to fit removably within and substantially fill said assembly tray, the bottoms of said storage trays being located adjacent the bottom of said assembly tray and engaging any assembled puzzle pieces therein to hold such pieces in assembled relationship, filler blocks for each of said storage trays, each of said filler blocks being sized and shaped so as to fit removably within and substantially fill the respective storage tray, the bottoms of said blocks engaging any unassembled puzzle pieces in said storage trays and preventing such pieces from becoming inverted within said storage trays, a removable cover for said trays, said cover having a bottom wall underlying the bottom wall of said assembly tray and having four side walls hinged to the bottom wall of the cover and adapted to lie along the outer sides of the side walls of said assembly tray, a sheet of resiliently compressible material located between the bottom wall of said assembly tray and the bottom wall of said cover and secured to one of such bottom walls, said cover further including cover flaps hinged to the side walls of said cover and adapted to be folded to closed positions over the outer sides of said blocks, and means for releasably holding said flaps in said closed positions, said flaps being operable when in said closed positions to hold said blocks in said storage trays and to hold said storage trays in said assembly tray when the assembly tray with the storage trays and blocks therein is turned on edge and transported.

3. A device as defined in claim 2 in which two of said cover flaps are hinged to oppositely disposed side walls of said cover, each of the latter flaps having rectangular dimensions which are at least as great as the rectangular dimensions of one of said storage trays.

4. A device as defined in claim 2 in which each of said storage trays is made of paperboard, and a sheet of anti-skid material secured to the lower side of the bottom wall of each storage tray to restrict slippage of any assembled puzzle pieces in said assembly tray when said storage trays are disposed in said assembly tray.

5. A device as defined in claim 4 in which said sheets of anti-skid material are resiliently compressible and are cemented to said storage trays.

6. A device as defined in claim 2 in which said sheet is cemented to the bottom wall of said cover.

7. A device as defined in claim 2 in which said filler blocks are made of styrofoam.

8. A device as defined in claim 2 in which one of the side walls of said assembly tray is hinged to the bottom wall thereof and is adapted to be folded downwardly to a horizontal position.

9. A device as defined in claim 2 in which a bail-type carrying handle is attached to the outer side of one of the side walls of said assembly tray, and a slot formed in the corresponding side wall of said cover, said handle projecting through said slot when said flaps are in said closed positions.

10. A device as defined in claim 2 in which said releasable holding means comprise coacting pieces of Velcro-type material on the inner sides of some of said flaps and on the outer sides of other ones of said flaps.

11. A device for facilitating assembly of a jigsaw puzzle and for enabling the puzzle to be transported, said device comprising a generally rectangular assembly tray for holding assembled puzzle pieces, a plurality of generally rectangular storage trays for holding unassembled puzzle pieces, each of said trays having a bottom wall and four upstanding side walls, said storage trays being sized and shaped so as to fit removably within and substantially fill said assembly tray, the bottoms of said storage trays being located adjacent the bottom of said assembly tray and engaging any assembled puzzle pieces therein to hold such pieces in assembled relationship, filler blocks for each of said storage trays, each of said filler blocks being sized and shaped so as to fit removably within and substantially fill the respective storage tray, the bottoms of said blocks engaging any unassembled puzzle pieces in said storage trays and preventing such pieces from becoming inverted within said storage trays, a removable cover for said trays, said cover having a bottom wall underlying the bottom wall of said assembly tray and having four side walls hinged to the bottom wall of the cover and adapted to lie along the outer sides of the side walls of said assembly tray, said cover further including cover flaps hinged to the side walls of said cover and adapted to be folded to closed positions over the outer sides of said blocks, means for releasably holding said flaps in said closed positions, said flaps being operable when in said closed positions to hold said blocks in said storage trays and to hold said storage trays in said assembly tray when the assembly tray with the storage trays and blocks therein is turned on edge and transported, a carrying handle attached to one of the side walls of said assembly tray, a slot formed in the corresponding side wall of said cover, said handle projecting through said slot when said flaps are in said closed positions, and a flap hinged to the upper margin of the side wall of the assembly tray opposite the side wall to which said handle is attached, said tray flap being located between said blocks and at least one of said cover flaps when said cover flaps are in said closed positions.

* * * * *